United States Patent [19]

Ballway

[11] Patent Number: 5,040,719

[45] Date of Patent: Aug. 20, 1991

[54] COMBINATION DRINKING VESSEL AND CUP HOLDER WITH STORABLE INSERT

[76] Inventor: John A. Ballway, 93 N. Stoughton St., Bergenfield, N.J. 07621

[21] Appl. No.: 490,782

[22] Filed: Mar. 8, 1990

Related U.S. Application Data

[63] Continuation-in-part of Ser. No. 326,157, Mar. 20, 1989, Pat. No. 4,928,848.

[51] Int. Cl.[5] ..... A47G 19/22; A47G 23/00; A47G 23/03

[52] U.S. Cl. ..... 229/1.5 H; 229/103.1; 229/906.1; 215/6; 215/10; 215/12.1; 215/228; 220/85 H; 220/90.2; 220/504

[58] Field of Search ..... 220/85 H, 90.2, 903, 220/425, 444, 504, 22; 215/12.1, 12.2, 13.1, 100.5, 228, 227, 229, 1 A, 6, 10; 206/217; 229/1.5 H, 906.1, 103.1

[56] References Cited

U.S. PATENT DOCUMENTS

| | | | |
|---|---|---|---|
| D. 230,239 | 2/1974 | Dodge | D7/9 |
| D. 286,967 | 12/1986 | Appel | D7/9 |
| D. 290,571 | 6/1987 | Rowe | D7/70 |
| 1,334,342 | 3/1920 | Woods | 220/85 H |
| 2,329,512 | 9/1943 | Clifford, Jr. | 215/100.5 |
| 2,374,092 | 4/1945 | Glaser | 215/6 |
| 2,483,168 | 9/1949 | Amberg | 229/1.5 H X |
| 2,509,133 | 5/1950 | Carew | 229/1.5 H X |
| 2,661,889 | 12/1953 | Phinney | 229/906.1 X |
| 2,704,444 | 3/1955 | Carew | 229/1.5 H X |
| 2,782,616 | 2/1967 | Eron | 229/1.5 H X |
| 2,805,017 | 9/1957 | Hill et al. | 229/1.5 H |
| 2,895,636 | 7/1959 | Martin | 215/12.1 X |
| 2,909,300 | 10/1959 | Engram | 215/12.1 |
| 2,910,219 | 10/1959 | Bennet et al. | 229/1.5 H |
| 3,107,028 | 10/1963 | De Robertis | 220/85 H X |
| 3,232,512 | 2/1966 | Wanderer | 229/1.5 H |
| 3,302,427 | 2/1967 | Stoner et al. | 220/903 X |
| 3,337,109 | 8/1967 | Shumrak | 229/1.5 H |
| 3,350,131 | 10/1967 | Tanzer | 215/100.5 X |
| 3,534,736 | 10/1970 | Meyers | 215/6 X |
| 3,765,559 | 10/1973 | Sauey et al. | 215/12.1 X |
| 3,766,975 | 10/1973 | Todd | 215/12.1 X |
| 3,804,281 | 4/1974 | Eckdahl | 215/12.1 |
| 4,111,303 | 9/1978 | Compton | 206/520 |
| 4,441,623 | 4/1984 | Antoniak | 229/906.1 X |
| 4,467,934 | 8/1984 | Hummer | 220/85 H |
| 4,795,108 | 1/1989 | Wittig et al. | 229/1.5 H X |

FOREIGN PATENT DOCUMENTS

| | | | |
|---|---|---|---|
| 1397877 | 6/1975 | United Kingdom | 220/425 |

*Primary Examiner*—Sue A. Weaver
*Attorney, Agent, or Firm*—Kenneth Watov

[57] ABSTRACT

A combination drinking vessel and cup holder having a chamber at one end of said vessel, said chamber having a bottom at an intermediate point of said vessel and an open end with a lip at one end of said vessel; a cavity at the other end of said vessel on the other side of the bottom of the chamber, said cavity having an open end with a lip at the other end of said vessel; an insert that fits in the bottom of said chamber for supporting a cup, and in said cavity for storage thereof; complementary holders in said cavity and in said insert for removably retaining the insert; and a cap that snaps over the lip of the chamber to serve as a cover, and that snaps over the lip of said cavity to serve as a coaster.

20 Claims, 4 Drawing Sheets

COMBINATION DRINKING VESSEL AND CUP HOLDER WITH STORABLE INSERT

RELATED PATENT APPLICATION

This is a Continuation-In-Part of co-pending U.S. Pat. application Ser. No. 07/326,157 entitled "Combination Drinking Vessel And Cup Holder With Convertible Cup/Coaster" and filed on Mar. 20, 1989 in the name of John Arthur Ballway, now U.S. Pat. No. 4,928,848. The teachings of Ser. No. 07/326,157 are incorporated herein by reference.

FIELD OF THE INVENTION:

This invention is in the field of drinking vessels adapted to hold cups of different sizes.

BACKGROUND OF THE INVENTION

There are many examples in the prior art of various holders for beverage cans, paper cups, coffee cups, and so forth. A number of these prior references are discussed below.

Mousett, Design Patent Nos. Des. 229,153 and Des. 229,156, each show beverage can holders that are shaped to appear as beer mugs.

Moore, U.S. Pat. No. 1,389,594, discloses a paper cup holder having a truncated cone-like shape for receiving a substantial lower portion of a paper cup, whereby the paper cup is nestled within the holder and rests against the bottom of the latter. The holder is provided with a finger handle.

Prentice. U.S. Pat. No. 3,013,691 discloses a holder for beverage cans. The holder has a mug-like appearance, and is double walled in order to provide dead air spaces for thermally insulating a beverage can contained within the holder from ambient temperatures.

Studen. U.S. Pat. No. 3,473,682 discloses an insulated jacket of unicellular expanded polyethylene foam that is tubularly shaped and dimensioned for fitting snugly about a substantial portion of the lower portions of a drinking utensil, such as a cup or tumbler. The jacket may also serve as a coaster.

D'Ercoli, U.S. Pat. No. 3,596,795 discloses a reusable cup holder of truncated conical shape, and including a series of circumferential locking rings or ribs or grooves successively arranged about an uppermost portion of the interior wall of the holder, for mating with similar rings or grooves on a drinking cup placed within the holder, in order to better secure the cup within the holder. A protruding finger handle is provided on the holder.

Compton, U.S. Pat. No. 4,111,303 discloses a plastic nestable container having side walls diverging from top to bottom, and shoulder-like projections on the upper and lower portions of the outside of the container, for permitting easy nesting of the container or cups for purposes of shipment, storage, and disbursement. In this manner, separation of the cups is also resisted. A similar design for a cup is disclosed in Day, U.S. Pat. No. 4,124,120.

Coles, et al., U.S. Pat. No. 4,610,351 shows an insulated drinking cup of thermoplastic material. The mouth of the cup includes a wall portion that is turned over and downward to form an extending collar about the mouth. The collar extends circumjacent the upper inner portion of the cup, for providing a user with a holding collar that is substantially insulated from the inner wall of the cup, preventing the collar from becoming hot when hot beverages are contained within the cup.

Henderson, U.S. Pat. No. 4,648,525 teaches a one piece beverage insulator holder having an open top, and support base formed from an insulative foam material. The holder is dimensioned to fit snugly about a substantial portion of a beverage container.

Manns, U.S. Pat. No. 4,681,239 discloses another form of holder for containers. The holder includes an elongated, annular, sidewall and a bottom portion for forming a cylindrical interior portion for snugly fitting about a container to be held therein. A rim is provided on the outer surface of the annular sidewall.

Jeff, U.S. Pat. No. 4,720,023 discloses an insulated mug and beverage can holder consisting of a one-piece flexible ring-shaped retainer with an annular groove mounted on an upper rim of the insulated mug. The annular groove includes an outside lip that is slightly inwardly biased, and is slightly smaller in diameter than the outside of the flared or beaded portion of the mug to which it is fastened. The inner edge of the flexible retainer includes inwardly facing tabs, with the diameter of the inner edge being smaller than the diameter of a beverage can to be held within the mug, thereby providing positive retention of the beverage can within the mug. The base of the mug is recessed and similar in size and shape to the top of the mug, for permitting the flexible retainer to be stored on the base of the mug when it is being used as a drinking vessel.

It is known to provide beverage coolers in the form of a drinking mug. For example, a styrofoam cooler shaped in the form of a giant drinking mug is sold by "Promotions Unlimited", of Benton Harbor, Mich.

BRIEF DESCRIPTION OF THE INVENTION

The drinking vessel of the parent application that is briefly described just above is in the form of a mug having a frustaconical permanent cup mounted therein with its larger end adjacent the lip of the mug. Although the fluid to be drunk can be in the permanent cup, it is also possible for it to be in a disposable cup that is retained in the permanent cup with its lip adjacent the lip of the mug. In order that disposable cups that are shorter and which may have different tapers may be used, a plurality of inserts are provided that fit in the lower part of the permanent cup so as to provide raised platforms on which smaller respective disposable cups can rest and have their lips adjacent the lip of the mug.

In the drinking vessel just described, the disposable cups are stored in a convenient location, but in accordance with the invention of this Continuation-In-Part application the permanent cup is eliminated, a bottom is provided for the mug so that it can hold liquid, and a cavity is formed in the mug on the other side of the bottom for storing inserts. Various means may be provided for retaining an insert in the cavity. For example, the walls of the cavity may be cylindrical and have such diameter as to form an easy press fit with the outer wall of the insert. In a second specie of the invention the cavity is cylindrical and an inwardly extending complete circumferential ridge is formed around its wall that snaps into circular grooves on the outer wall of the insert. In order to remove the insert, it is only necessary to pull it in an axial direction away from the bottom of the mug. The means required to exert this axial force may be provided by a finger hole in the insert. In a third specie of the invention, inwardly extending circular ridges are formed in separated arcuate sections of the cylindrical wall of the cavity that fit into grooves on the outside walls of axially extending tabs. In the last structure, the insert can be removed by turning it about its axis until its tabs respectively lie in the spaces between the arcuate ridges and then pulling it away from the bottom of the mug in an axial direction.

BRIEF DESCRIPTION OF THE DRAWINGS

With reference to the drawings, wherein like items are identified by the same reference designation, the invention will be described with reference thereto, wherein.

DETAILED DESCRIPTION OF THE INVENTION

Figure 1A:
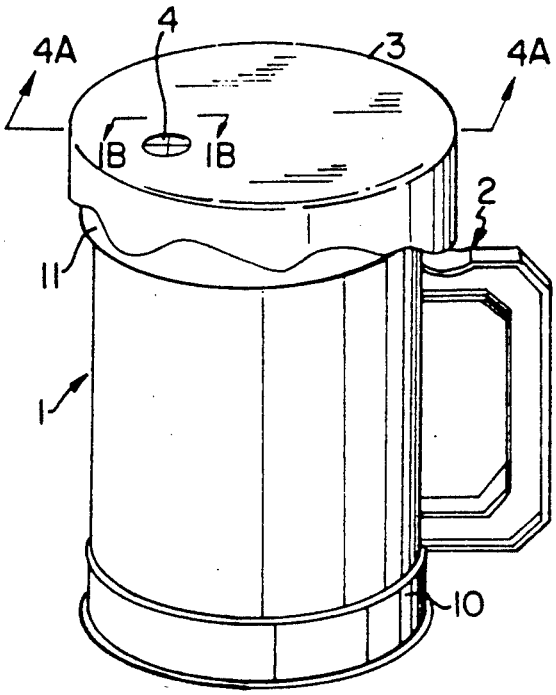
FIG. 1A is a perspective view of one embodiment of the invention.
Figure 1B:
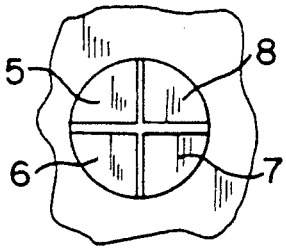
FIG. 1B is an enlarged plan view taken along line 1B—1B of FIG. 1A.

FIG. 1A shows a drinking vessel 1 having the form of a beer mug with a handle 2, made of material having an "H" shaped cross section, in this example. A cap 3 shaped so as to give the appearance of overflowing foam is mounted over the top of the vessel 1 so as to prevent spillage and is provided with an opening 4 through which a straw may be inserted. As shown in more detail in FIG. 1B, the opening 4 is resiliently closed by four quarter pie-like flaps 5, 6, 7 and 8 so as to accommodate straws of different sizes and reduce the opening through which liquid in the vessel can escape. Outwardly extending flanges 10 and 11 are located at the bottom and top respectively of the vessel 1.

Figure 2:
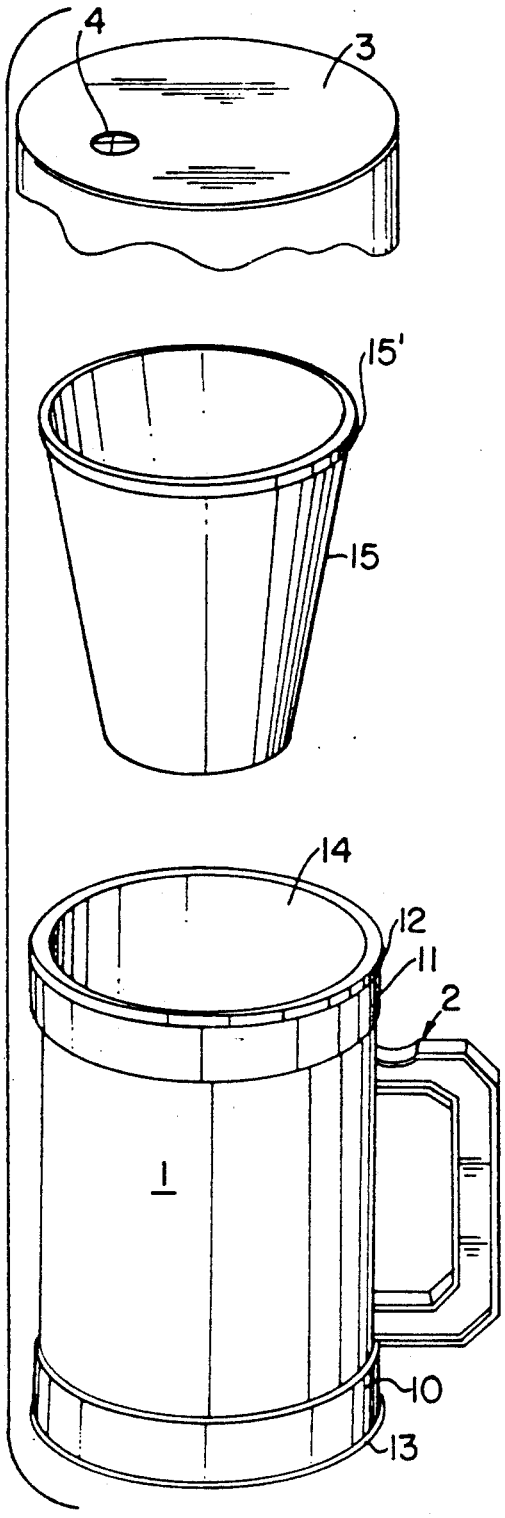
FIG. 2 is an exploded perspective/assembly view of one embodiment of the invention.

As shown in the exploded view of FIG. 2, a rolled over lip 12 at the top of the vessel 1 protrudes outside of the flange 11. A similar lip 13 protrudes outside of the flange 10. Although the liquid to be drunk can be contained in a chamber 14 within the vessel 1, it can also be contained within a disposable cup 15 that can be dropped into the chamber 14 that can be covered by the cap 3. A lip 15' extends outwardly from the upper end of the cup 15.

Figure 3:
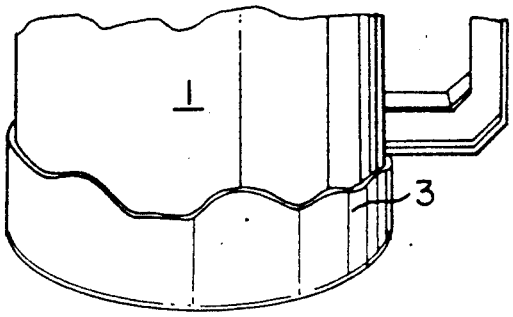
FIG. 3 is a perspective view of a portion of an embodiment of the invention showing the dual functioning cap serving as a coaster via attachment to the bottom of the illustrated vessel.

FIG. 3 shows the cap 3 mounted on the bottom of the vessel 1 so as to serve as a coaster.

Figure 4A:
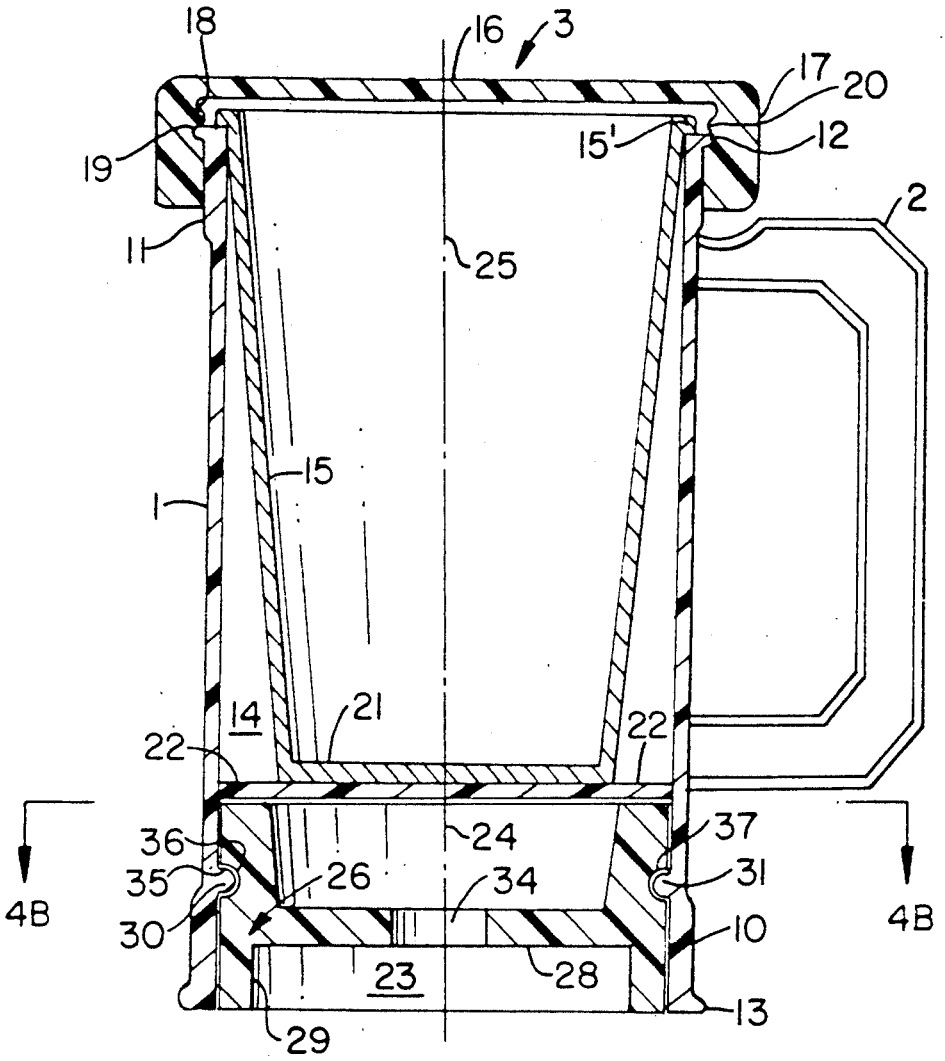
FIG. 4A is a sectional view of the embodiment of FIG. 1A taken along line 4A—4A thereof and showing an insert in a stowed position.

Reference is now made to the vertical cross-section of FIG. 4A. The cap 3 is formed by a disc 16 having a downwardly extending annular rim 17. Upper and lower grooves 18 and 19 on the inside of the rim 17 are spaced by a rib 20. The cap 3 is secured in place by a snap locking means, wherein the lower groove 19 engages the protruding lip 12 of the vessel. The height of the rib 20 is sufficient to prevent downward pressure on the cap 3 from crushing the lip 15' of a disposable cup 15 against the rolled over lip 12. When the cap 3 is to be used as a coaster, it is pushed onto the bottom of the vessel 1 so that the groove 18 engages the lip 13. The groove 18 and the lip 13 are snap locking means. Although the disposable cup 15 could be supported by the engagement of its lip 15' with the lip 12 of the vessel 1, it is preferable that its bottom 21 rest on the bottom 22 of the chamber 14.

Figure 5:
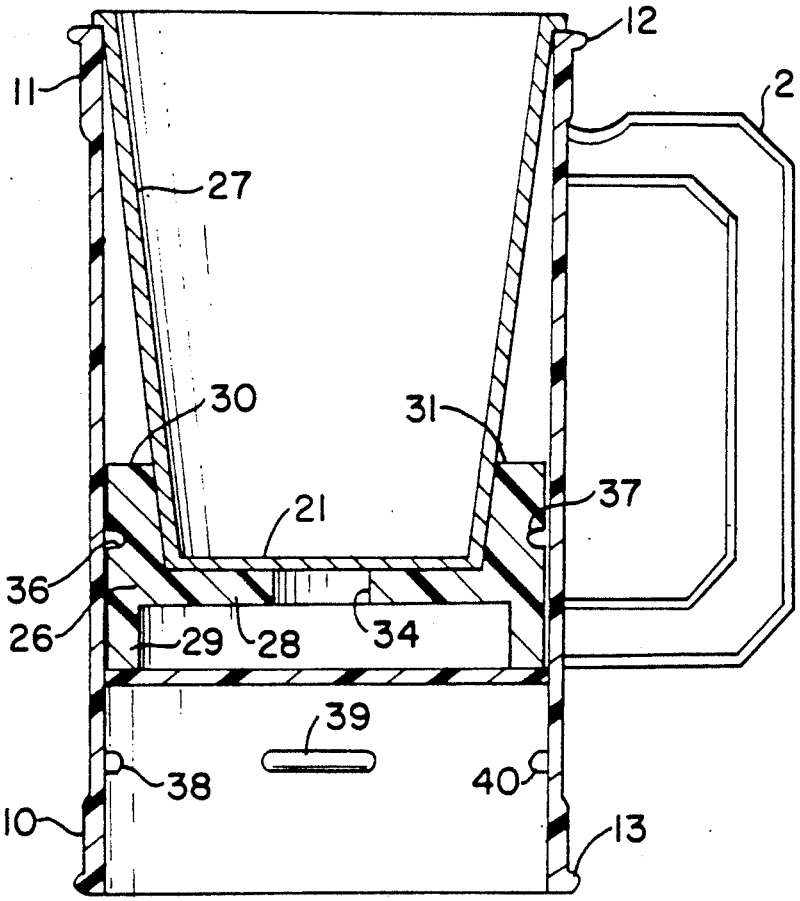
FIG. 5 is a longitudinal cross-sectional view of the embodiment of FIG. 1A with an insert supporting a disposable cup.

Consideration is now given to the parts of FIG. 4A that specifically relate to the structure added by this Continuation-In-Part Application. A cavity 23 is formed in the vessel 1 below the bottom 22 of the chamber 14 that is preferably cylindrical in shape and has an axis 24 coinciding with the axis 25 for the chamber 14 and the disposable cup 15. An insert 26 is removably stored in the cavity 23 by any suitable means. As shown in FIG. 5, the insert 26 is being used to support a cup 27 that is shorter than the cup 15, via placement of insert 26 in the bottom of the chamber 14.

Figure 4B:
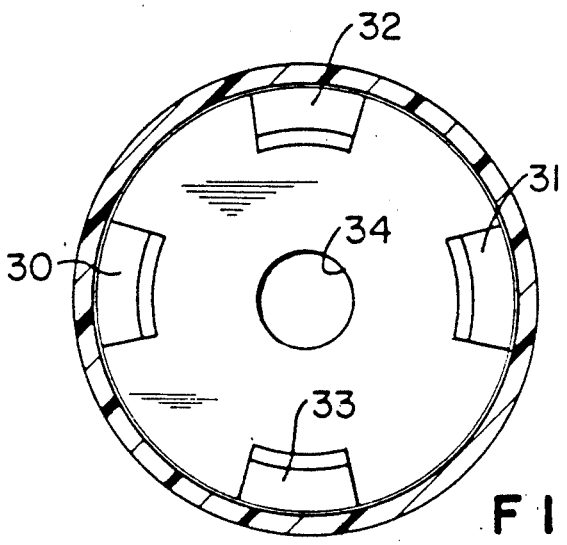
FIG. 4B shows a sectional view along line 4B—4B of FIG. 4A for one embodiment of the invention.

One of the configurations that the insert 26 may have is shown in FIGS. 4A and 5. It is comprised of a circular web 28 having a circular flange 29 on one side and four equally spaced finger-like axial projections extending in an axial direction on the opposite side of the web 28. Only two projections 30 and 31 are shown in the cross-sectional views of FIGS. 4A and 5, but the tops of all the projections 30, 31, 32 and 33 are seen in FIG. 4B. The outer surfaces of the projections and the outer surface of the flange 29 are cylindrical about the axis 24, and the inner surfaces of the projections 30 through 33 are tapered so as to fit the bottom portion of the disposable cup 27, as shown in FIG. 5. A hole 34 is formed in the web 28 of such size that an index finger can be thrust through it.

Figure 4C:
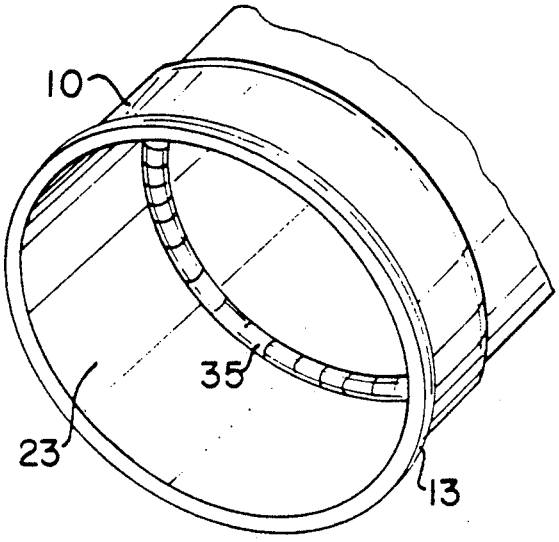
FIG. 4C is a bottom projection view of the cavity in the bottom of the vessel of FIG. 4A for one embodiment of the invention.

Various means may be provided for removably attaching the insert 26 in the cavity 23. As shown in FIG. 4C, a ridge 35 is formed on the inner cylindrical wall of the cavity 23 that is in the same radial plane about the axis 24 as grooves such as 36 and 37 in the outer cylindrical surfaces of the finger-like projections 30 and 31 when the insert 26 is in the stored position. The insert 26 can be stored in the cavity 23 by simply pressing it therein until the ridge 35 snaps into the grooves such as 36 and 37. For this action to take place, the ridge 35 and/or projections 30–33 should be made of pliable plastic material having a memory. Removal of the insert 26 from the cavity 23 or from the bottom of the chamber 14 is facilitated by inserting a finger through the hole 34 and pulling.

An alternative means for removably attaching the insert 26 in the cavity 23 is to replace the ridge 35 of FIGS. 4A and 4C with four symmetrically located spaced arcuate ridges including ridges 38, 39 and 40, shown in FIG. 5, that are in the same radial plane as the single ridge 35 would be. The circumferential lengths of these ridges are less than the circumferential distance between grooves in adjacent axial projections so that the insert 26 can be placed in or removed from the cavity 23 by rotating it until the axial projections are in spaces between the ridges and then turning it in the appropriate direction about the axis 24.

Figure 6:
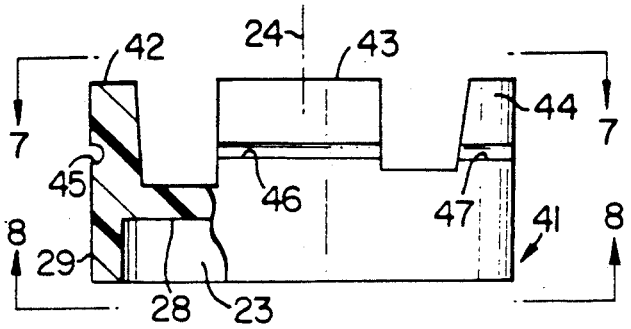
FIG. 6 is a partially broken away side-elevation view of an insert of the present invention having three axial finger-like projections in one embodiment of the invention.
Figure 8:
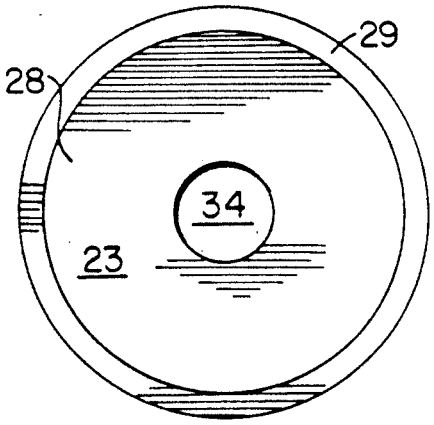
FIG. 8 is a bottom plan view taken along line 8—8 of the embodiment of FIG. 6.
Figure 7:
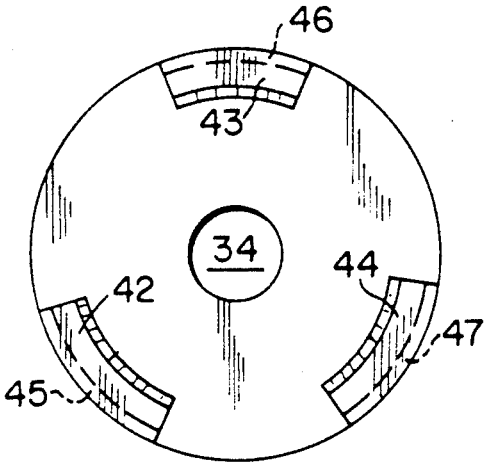
FIG. 7 is a top plan view taken along line 7—7 of the embodiment of FIG. 6.

FIGS. 6, 7, 8 and 9 illustrate an insert 41 that is like the insert 26 except that it has three finger-like axial projections 42, 43 and 44 instead of four. FIG. 6 is a partial cross sectional view of the insert 41 taken along a direction that is perpendicular to its axis 24 and shows circumferential grooves 45, 46 and 47 in the outer surfaces of the axial projections 42, 43 and 44, respectively, that could engage the circumferential ridge 35 shown in FIG. 4C or spaced arcuate ridges, not shown, that are like the ridges 38, 39 and 40 of FIG. 5 except that they are spaced by 120° instead of 90°, as shown in FIG. 10.

Figure 9:
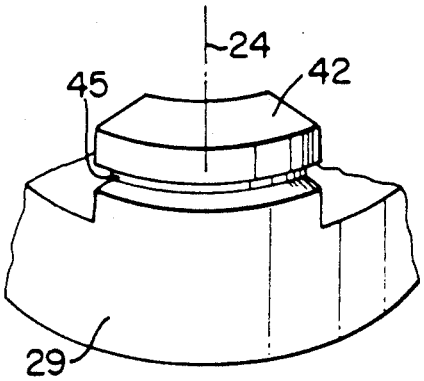
FIG. 9 is an outside projection view of one of the axial projections of FIG. 6.
Figure 10:
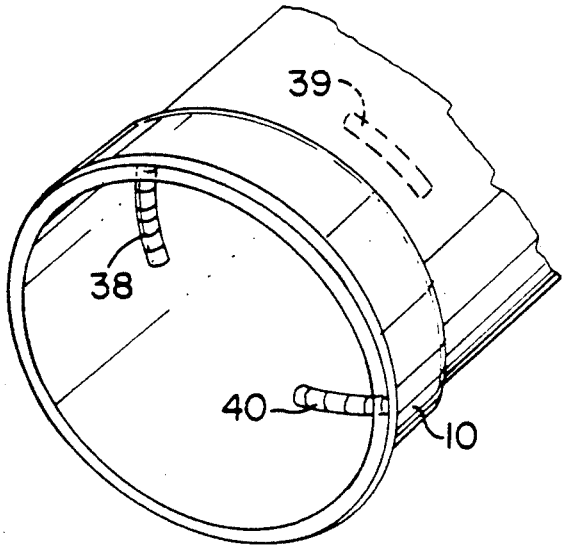
FIG. 10 is a bottom projection view of the cavity in the bottom of the vessel of another embodiment of the invention.

FIG. 9 is a projection view of a portion of the insert 41 showing a groove 45 in its outer surface.

Although various embodiments of the invention have been shown and described herein, for purposes of illustration, various modifications of such embodiments may occur to those of skill in the art. These modifications are meant to be covered by the spirit and scope of the appended claims. For example, the chamber 14 and insert 26 are shown and described as being cylindrical, but can be otherwise shaped. Alternative shapes therefore could be hexagonal, square, or some other shape within practical limits for the purposes thereof, for example. Also, an alternative for insert 26, is to locate groove 45 as a continuous groove in a lower portion of flange 29, thereof, in conjunction with either ridge 35 or arcuate ridges 38, 39, 40, for example, lowered relatively lower in cavity 23 of vessel 1 than illustrated. Another alternative is to form a circumferential groove about the inside well of cavity 23, and to place mating protruding ridges or projections circumferentially on the outside wall of insert 26.

What I claim is:

1. A combination drinking vessel and cup holder comprising:

a vessel;

means defining a chamber in one end of said vessel, said chamber having a ;bottom and an open top;

means defining a cavity in said vessel on the other side of said bottom;

an insert dimensioned to fit into the bottom of said chamber so as to support a disposable cup therein; and complementary means in said cavity and on the outside of said insert for removably holding said insert in said cavity, when it is inserted therein.

2. A combination drinking vessel as set forth in claim 1, wherein said complementary means includes:

an external surface on said insert that is ;cylindrical;

means defining a circumferentially extending groove in said external surface;

a cylindrical wall in said cavity; and a ridge located on said cylindrical wall at such a location as to engage said groove.

3. A combination drinking vessel as set in claim 1 wherein:

said chamber is cylindrical;

and wherein said complementary means includes:

said cavity having a cylindrical wall and an axis;

spaced circumferential arcuate ridges formed on said cylindrical wall;

said insert including a circular web having an axis and axial finger-like projections extending from one side thereof that are spaced so as to fit between said ridges when the axis of said insert coincides with the axis of said cavity with said insert having a first rotational position with respect to said cavity; and means for defining circumferential grooves in the external surfaces of said projections that are oriented and dimensioned to respectively engage said ridges when said insert is in a second rotational position within said cavity.

4. The vessel of claim 1, further including a handle rigidly attached to the outside wall of said vessel.

5. The vessel of claim 1, wherein said vessel further includes a first band-like flange outwardly projecting from an uppermost circumferential portion of the outside wall thereof.

6. The vessel of claim 5, wherein said vessel further includes a second band-like flange outwardly projecting from a lowermost circumferential portion of the outside wall thereof.

7. The vessel of claim 6, wherein said vessel further includes:

a first rolled over lip forming the topmost circumferential portion of said first flange; and a second rolled over lip forming the lowermost circumferential portion of said second flange.

8. The vessel of claim 7, further including a cap, said cap including snap locking means for permitting said cap to, in one mode of use, serve as a cover by being pushed over the top of said vessel and secured thereto via snap locking with said first lip, and in another mode of use to serve as a coaster by being pushed over the bottom of said vessel, and secured thereto via snap locking with said second lip.

9. The vessel of claim 8, wherein said cap further includes crush prevention means for limiting the extent said cap can be readily pushed down upon the top of said vessel, for preventing crushing of the lip of a drinking cup held within said chamber.

10. The vessel of claim 9, wherein said snap locking means includes a first inner circumferential groove proximate the bottom edge of said cap.

11. The vessel of claim 10, wherein said crush prevention means of said cap includes:

a second inner circumferential groove located above said first groove; and a radially inward projecting circumferential rib located between and separating said first and second grooves, said rib limiting the extent of downward positioning of said cap on said vessel, and said second groove providing space for the top portion of a cup substantially within said chamber, with the topmost portion of the cup being within said cap, when positioned over said vessel.

12. The vessel of claim 8, wherein said cap includes straw hole means through its top surface, for permitting a straw to be inserted therethrough partially into said chamber, when said cap is covering said vessel.

13. The vessel of claim 12, wherein said straw hole means further includes sealing means for substantially closing off said straw hole means whenever a straw is not inserted therethrough.

14. The vessel of claim 7, further including said insert means being dimensioned to fit snugly within a lower portion of said chamber for permitting a given size of cup to have its lip juxtaposed to said first lip, when said cup is within said chamber, thereby facilitating the containment of a different sized drinking cup within said chamber with easy drinking therefrom.

15. The vessel of claim 14, wherein said insert means includes a web for receiving the bottom of a drinking cup, a flange extending from one side of said web, and a plurality of finger-like axial projections extending from the other side of said web between which the bottom portion of an associated cup can be snugly nested, for substantially securing said cup within said chamber.

16. The drinking vessel of claim 1, wherein said vessel is fabricated from a suitable plastic material.

17. The drinking vessel of claim 1, wherein said vessel is fabricated from polypropylene.

18. The drinking vessel of claim 8, wherein said cap has side portions shaped to simulate foam dripping over the top and down the sides of said vessel when covered by said cap.

19. A drinking vessel of claim 1, shaped to appear as a beer mug.

20. A drinking vessel providing for both drinking directly therefrom and holding a cup comprising:

a vessel;

outwardly projecting first and second band-like flanges about the uppermost and lowermost portions of the outside wall of said vessel, respectively;

a first rolled over lip projecting from the topmost portion of said first flange;

a second rolled over lip projecting from the lowermost portion of said second flange;

a handle rigidly attached to the outside wall of said vessel;

means defining a cylindrical chamber at one end of said vessel, said chamber having a bottom;

means defining a cylindrical cavity at the other end of said vessel that is on the other side of said bottom, said cavity having an axis;

a cap including interior juxtaposed uppermost and lowermost parallel circumferential grooves, separated by a circumferential rib therebetween, said lowermost groove serving to snap lock onto said first lip for securing said cap to the top of said vessel, said rib limiting the extent said cap can be pushed down upon the top of said vessel, the combination of said rib, and the area provided by said uppermost groove, protecting a lip or top portion of a cup mounted within said chamber;

said cap serving as a coaster via said lowermost groove being snap locked over said second lip, for securing said cap to the bottom of said vessel;

said cap including on its top surface means defining a hole for receiving a straw therethrough so that it can pass into said chamber, and sealing means for effectively sealing said through hole when not in use;

an insert dimensioned so as to fit in the portion of said chamber adjacent the bottom of said chamber and snugly fit the bottom of a cup mounted thereon.

said insert having a web, a flange extending from one side of said web and finger-like projections extending from the other side of said web, the outer surfaces of said projections being cylindrical about an axis;

means defining circumferential arcuate ridges extending from the wall of said cavity, said ridges being spaced so as to permit said projections to be respectively inserted between them when the axis of said insert coincides with the axis of said cavity and is in a first rotational position; and means defining circumferential grooves in the outer surfaces of said projections that can engage said arcuate ridges and retain said insert in said cavity when the insert is in a second rotational position.

* * * * *